United States Patent [19]

Morita et al.

[11] 4,432,315

[45] Feb. 21, 1984

[54] IGNITION ARRANGEMENT FOR INTERNAL COMBUSTION ENGINE

[75] Inventors: Yasuyuki Morita; Hiroyuki Oda, both of Hiroshima, Japan

[73] Assignee: Toyo Kogyo Co., Ltd., Hiroshima, Japan

[21] Appl. No.: 294,507

[22] Filed: Aug. 20, 1981

[30] Foreign Application Priority Data

Sep. 1, 1980 [JP] Japan ..... 55-121631

[51] Int. Cl.[3] ..... F02P 1/00; F02P 3/02; F02M 7/00; F02M 25/06

[52] U.S. Cl. ..... 123/310; 123/638; 123/193 H

[58] Field of Search ..... 123/193 H, 638, 310, 123/306, 661, 309, 657, 193 R, 193 GH

[56] References Cited

U.S. PATENT DOCUMENTS

| | | | |
|---|---|---|---|
| 3,919,994 | 11/1975 | Munden | 123/638 |
| 3,935,844 | 2/1976 | Nishimiya et al. | 123/638 |
| 4,116,179 | 9/1978 | Nagumo et al. | 123/310 |
| 4,116,180 | 9/1978 | Hayashi et al. | 123/310 |
| 4,116,181 | 9/1978 | Nakajima et al. | 123/310 |
| 4,133,331 | 1/1979 | Otsubo et al. | 123/309 |
| 4,198,942 | 4/1980 | Kuroda et al. | 123/638 |
| 4,201,175 | 5/1980 | Tanaka et al. | 123/193 H |
| 4,224,918 | 9/1980 | Tanaka et al. | 123/310 |

*Primary Examiner*—Raymond A. Nelli

*Attorney, Agent, or Firm*—Wenderoth, Lind & Ponack

[57] ABSTRACT

An improved ignition arrangement for internal combustion engines includes, besides an ignition plug normally employed, another ignition plug provided on a guide surface confronting an exhaust port side of a guide wall for prevention of knocking by properly determining ignition time, with a simultaneous improvement of combustibility.

8 Claims, 4 Drawing Figures

IGNITION ARRANGEMENT FOR INTERNAL COMBUSTION ENGINE

BACKGROUND OF THE INVENTION

The present invention generally relates to an internal combustion engine and more particularly, to an engine ignition arrangement having two ignition plugs for use in internal combustion engines.

Commonly, it has been well known that, if a swirl of an air-fuel mixture is arranged to be formed in a circumferential direction within a combustion chamber during an intake stroke of an engine so as to effect ignition with respect to such swirl, favorable ignition and combustion are achieved, even if the air-fuel mixture is lean.

Accordingly, there have conventionally been proposed several intake arrangements or intake constructions for forming a swirl of the air-fuel mixture during the intake stroke of internal combustion engines, for example, a combustion chamber construction in which a guide wall is provided to extend or project into the combustion chamber so as to cause the air-fuel mixture drawn from an intake port into the combustion chamber to swirl in the circumferential direction of the combustion chamber. Meanwhile, for the intake arrangements or intake constructions as described above, it has also been required to raise the compression ratio of the air-fuel mixture within the combustion chamber for the reduction of fuel cost and also for the improvement of combustion efficiency.

However, when the air-fuel mixture is highly compressed as described above, there are such disadvantages that, in addition to the tendency that the undesirable knocking phenomenon is liable to take place, if carbon adheres to a guide wall at the side of an exhaust port kept at high temperatures, an edge portion of such guide wall at the exhaust port side functions as a "heat point" different from a normal ignition plug for ignition, thus also resulting in the possibility of the knocking phenomenon. Particularly, in a large load and low speed rotation range of the engine, the generation of knocking is conspicuous, since the swirling speed of the intake air-fuel mixture is low, with a consequent delay of the flame propagation and low combustion speed, as compared with other operational ranges of the engine.

SUMMARY OF THE INVENTION

Accordingly, an essential object of the present invention is to provide an improved ignition arrangement for internal combustion engines in which, besides an ignition plug normally employed, another ignition plug is provided on a guide surface confronting an exhaust port side of a guide wall for prevention of knocking by properly determining ignition timing, with a simultaneous improvement of combustibility.

Another important object of the present invention is to provide an ignition arrangement of the above described type which is simple in construction and accurate in functioning at high reliability, and can be readily incorporated into various internal combustion engines at low cost.

In accomplishing these and other objects, according to one preferred embodiment of the present invention, there is provided an ignition arrangement for an internal combustion engine which includes a cylinder head constituting a combustion chamber together with a cylinder block, a guide wall formed to extend or project into the combustion chamber along part of an outer periphery of an intake valve seat and having a first guide surface for causing an air-fuel mixture taken in from an intake port to swirl in a circumferential direction of the combustion chamber, a second guide surface formed to confront an exhaust valve seat for an exhaust port and also to extend into the combustion chamber, and a third surface connected between the first and second guide surfaces, a first ignition plug provided between the intake port and exhaust port so as to confront the guide wall, a second ignition plug provided on the second guide surface of the guide wall, and an electrical circuit for causing the first and second ignition plugs to function under predetermined conditions.

By the arrangement according to the present invention as described above, an improved ignition arrangement for effectively preventing the undesirable knocking phenomenon has been advantageously presented, with substantial elimination of disadvantages inherent in the conventional ignition arrangements of this kind.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 1:
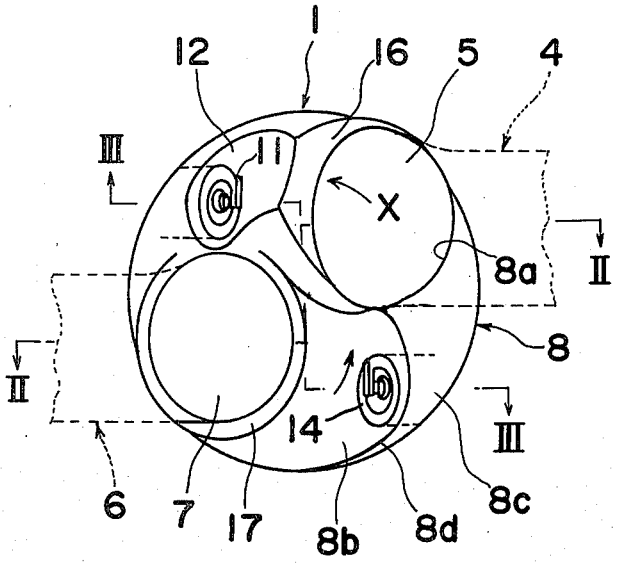
FIG. 1 is a schematic top plan view of a cylinder head of an engine to which an ignition arrangement of the present invention is applied, as viewed from a side of a combustion chamber.
Figure 2:
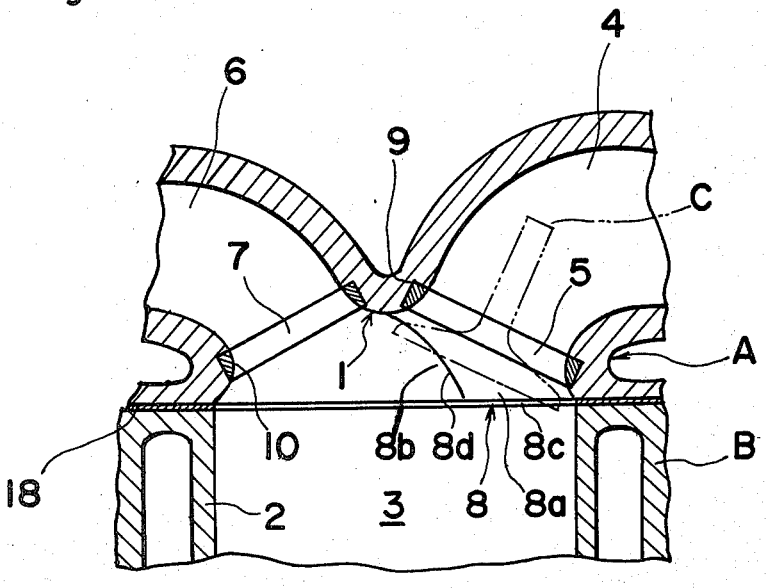
FIG. 2 is a cross section taken along the line II—II in FIG. 1.
Figure 3:
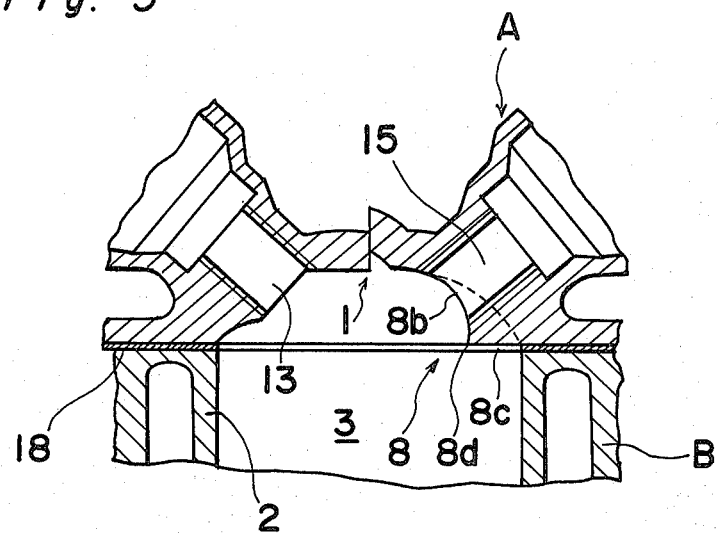
FIG. 3 is a cross section taken along the line III—III in FIG. 1.

Referring now to the drawings, there is shown in FIGS. 1 to 3, a cylinder construction of an internal combustion engine to which the ignition arrangement according to the present invention is applied. The cylinder construction generally includes a cylinder head A having a cylinder head wall surface 1 which is provided with an intake port 5 formed at a downstream end of an intake passage 4 and an exhaust port 7 formed at an upstream end of an exhaust passage 6, and a cylinder block B having a cylinder wall surface 2 and combined with the cylinder head A to constitute a combustion chamber 3 for the engine.

The cylinder construction further includes a guide wall 8 which extends from the vicinity of the intake port 5 of the cylinder head wall surface 1 into the combustion chamber 3 so as to improve combustibility by causing a combustion charge, i.e. an air-fuel mixture introduced through the intake port 5, to swirl in the circumferential direction of the combustion chamber 3.

The guide wall 8 as described above is arranged to project into the combustion chamber 3 along part of an outer periphery of an annular intake valve seat 9 fitted in the intake port 5, and includes a first guide surface 8*a* so formed as to cause the air-fuel mixture introduced through the intake port 5 during the intake stroke to swirl in the circumferential direction (indicated by an arrow X in FIG. 1) of the combustion chamber, a second guide surface 8*b* facing an annular exhaust valve seat 10 fitted in the exhaust port 7 and formed to project into the combustion chamber 3 so as to cause the air-fuel mixture to swirl in the circumferential direction of the combustion chamber towards an ignition plug 11 to be described later during the compression stroke, and a third surface 8*c* connecting said first guide surface 8*a* and second guide surface 8*b*.

Further included in the cylinder construction of FIGS. 1 through 3 are the first ignition plug 11 which is screwed into a threaded opening 13 formed in an ignition plug recess 12 provided in the wall surface between the intake port 5 and the exhaust port 7, with the forward end of said first ignition plug confronting the guide wall 8, and a second ignition plug 14 which is screwed into another threaded opening 15 formed in the second guide surface 8*b* of the guide wall 8, particularly, in the vicinity of an edge portion 8*d* thereof which becomes a "heat point" owing to high temperature due to confrontation thereof with the exhaust port 7. By the provision of the second ignition plug 14 as described above, the ignition time in the vicinity of the edge portion 8*d* is properly determined by second ignition plug 14, and there is no possibility that undesirable knocking is generated by the edge portion 8*d*, while adhesion of carbon to the guide wall at the exhaust port side is eliminated through an improvement of combustibility in the neighborhood of edge portion 8*d* for more effective suppression of the generation of knocking. Furthermore, by the two ignition plugs 11 and 14 as described above, the combustion speed of the air-fuel mixture is increased, with a consequent improvement of the combustibility.

It should be noted here that the first ignition plug 11 and the second ignition plug 14 as described above are so arranged that both of them function during low speed and large load periods wherein engine revolutions are lower than a predetermined set value, with engine load being larger than a predetermined set value, while only the first ignition plug 11 functions in the other operation range of the engine.

Still referring to FIGS. 1 to 3, the cylinder construction further includes an intake side hemispherical wall surface 16 formed along the other portion (i.e. the portion other than the portion where the first guide surface 8*a* is formed) around the periphery of the intake port valve seat 9, an exhaust side hemispherical surface 17 formed along part of the exhaust port valve seat 10, and a seal member 18 held between the cylinder head A and cylinder block B. It is to be noted that, in FIG. 2, only an intake valve C is shown in chain lines, with an exhaust valve being omitted for clarity.

Figure 4:
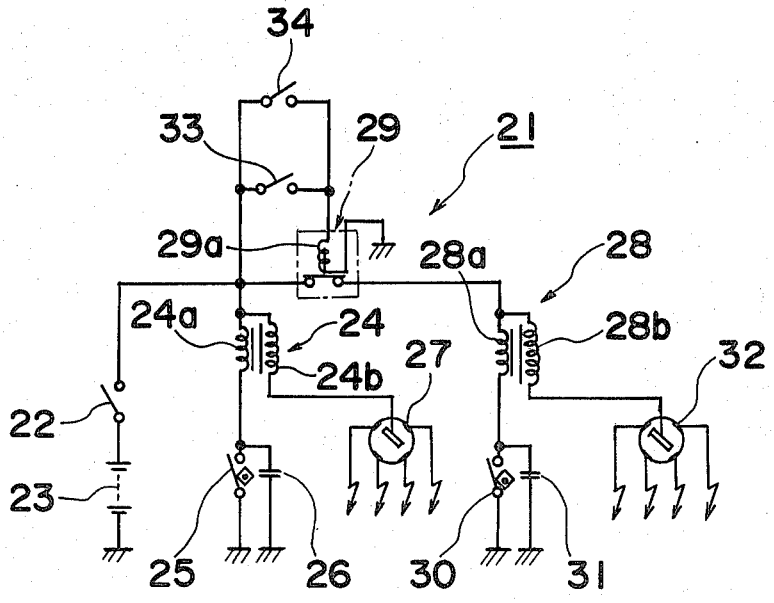
FIG. 4 is an electrical circuit diagram for the ignition arrangement according to the present invention.

Referring also to FIG. 4, an ignition circuit 21 for igniting the above two ignition plugs 11 and 14 will be described hereinbelow.

In the circuit arrangement of FIG. 4, an ignition switch 22 is connected, at its one end, to a power source battery 23, and a first ignition coil 24 having a first primary coil 24*a* and a first secondary coil 24*b* is connected in series to the other end of the switch 22. To the primary coil 24*a*, a parallel connection of a first interrupter 25 and a first capacitor 26 are connected in series, while the first ignition plug 11 (not shown here) is connected to the secondary coil 24*b* through a first distributor 27. Connected to the ignition switch 22 through a relay switch 29 is a second ignition coil 28 having a second primary coil 28*a* and a second secondary coil 28*b*. To the primary coil 28*a*, a parallel connection of a second interrupter 30 and a second capacitor 31 is connected in series, while the second ignition plug 14 (not shown here) is connected to the secondary coil 28*b* through a second distributor 32. The relay switch 29 has an exciting coil 29*a* connected, at its one end, to the ignition switch 22 through an engine revolution switch 33 and an engine load switch 34 which are connected in parallel with each other, and at its other end, to the ground.

The engine revolution switch 33 is arranged to be opened in the low revolution range where the engine revolutions are below the predetermined set value, and to be closed in the high revolution range where the engine revolutions are above the predetermined set value, while the engine load switch 34 is adapted to be opened at the large load range where the engine load is above the predetermined set value, and to be closed at a small load range where the engine load is below the predetermined set value. Accordingly, the second ignition coil 28 is connected to the battery 23 only during large load and low revolution periods.

By the above arrangement, during the large load and low revolution periods of the engine operation, the engine revolution switch 33 and engine load switch 34 are opened to retain the relay switch 29 in the closed state, and thus, both of the first and second ignition coils 24 and 28 are connected to the battery 23.

Consequently, the first and second ignition plugs 11 and 14 are both energized. Thus, by the ignition from the second ignition plug 14, the ignition time in the vicinity of the edge portion 8*d* is properly determined, and, since there is no possibility of undesirable adhesion of carbon to the edge portion 8*c* owing to the improvement of combustibility in the neighborhood of the second guide surface 8*b* of the guide wall 8, particularly, around the edge portion 8*d*, the generation of knocking during large load and low revolutions can be advantageously prevented.

Moreover, owing to the fact that the combustion speed during the large load and low revolution periods may be increased by the simultaneous function of both of the first and second ignition plugs 11 and 14, the combustibility can be appreciably improved.

Meanwhile, in the other operating range except for the large load and low revolution periods, it is so arranged that, at least one of the engine revolution switch 33 and engine load switch 34 is closed so as to open the relay switch 29 by energizing the exciting coil 29*a* of relay switch 29, whereby only the first ignition coil 24 is connected to the battery 23, and thus, only the first ignition plug 11 is ignited in a manner similar to that in conventional arrangements. At the above time, since the combustion speed is high, there is no possibility of generation of knocking, even if the second ignition plug 14 is not ignited. Additionally, since the ignition is effected by one ignition plug in the above operating range where knocking does not easily take place, the burden on the battery 23 may be alleviated.

On the other hand, the open/close timing of the second interrupter 30 is made faster than that of the first interrupter 25 by about 5 to 10 degrees in terms of the crank angle, and therefore, the second ignition plug 14 is ignited earlier than the first ignition plug 11 to a certain extent. In connection with the above, when the first and second ignition plugs 11 and 14 are simultaneously ignited, the portion in the vicinity of the second guide surface 8*b* is not efficiently scavenged, since such portion located at the rear of the swirling intake stream from the intake port 5 during the intake stroke is not sufficiently exposed to the fresh air-fuel mixture as compared with the first ignition plug 11 which is directly exposed to such fresh air-fuel mixture. Thus, the probability of knocking generation tends to be increased due to delay in the flame propagation by the second ignition plug 14 as compared with that by the first ignition plug 11. The disadvantage as described above may be eliminated by arranging the ignition timing of the second ignition plug 14 to be earlier than that of the first ignition plug 11. In the above case, the first and second ignition plugs 11 and 14 are substantially ignited at the same time in actual practice, and thus, proper ignition time may be achieved.

Furthermore, if the second ignition plug 14 is arranged to be ignited by a plasma ignition system, the combustibility in the vicinity of the second guide surface 8*b* with poor scavenging is further improved by a large ignition energy for more effective knocking prevention.

As is clear from the foregoing description, according to the present invention, since another separate ignition plug is provided at the guide surface confronting the exhaust valve seat of the guide wall for causing the air-fuel mixture to swirl, in addition to the ordinary ignition plug, the ignition time is made optimum through associated functioning of both ignition plugs, and thus, not only the generation of knocking is prevented, but the combustibility may be improved through increasing of the combustion speed.

Moreover, by causing both of the ignition plugs to function during the large load and low revolution periods when knocking tends to occur, the generation of knocking is suppressed more effectively.

It is another advantage of the present invention that, by arranging the ignition timing of the second ignition plug earlier than that of the first ignition plug, the possibility of knocking generation due to delay of flame propagation by the second ignition plug may be advantageously prevented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An ignition arrangement for an internal combustion engine which comprises:

a cylinder head forming a combustion chamber together with a cylinder block;

a guide wall formed to extend into said combustion chamber along part of an outer periphery of an intake valve seat and having a first guide surface for causing an air-fuel mixture taken in from an intake port to swirl in a circumferential direction of the combustion chamber, a second guide surface formed to confront an exhaust valve seat for an exhaust port and also to extend into said combustion chamber, and a third surface connected between said first and second guide surfaces;

a first ignition plug provided between said intake port and exhaust port so as to confront said guide wall;

a second ignition plug provided on said second guide surface of said guide wall; and electrical circuit means for causing said first ignition plug to function over the entire engine operating range and for causing said second ignition plug to function only in a predetermined engine operation range where engine knocking is apt to occur.

2. An ignition arrangement as claimed in claim 1, wherein said electrical circuit means causes both said first and second ignition plugs to function when engine revolutions are below a predetermined set value and engine load is above a predetermined set value, and causes only said first ignition plug to function when the engine revolutions are above the predetermined set value or the engine load is below the predetermined set value.

3. An ignition arrangement as claimed in claim 1, wherein said second ignition plug is arranged to be earlier in the ignition timing than said first ignition plug by a predetermined period of time.

4. An ignition arrangement as claimed in claim 1, wherein said second ignition plug is ignited by a plasma ignition system.

5. An ignition arrangement as claimed in claim 1, wherein said electrical circuit means includes an ignition switch connected at one end thereof to a power source, a first ignition coil having a first primary coil and a first secondary coil and connected in series to the other end of said ignition switch, a parallel connection of a first interrupter and a first capacitor connected in series to said first primary coil, said first ignition plug being connected to said first secondary coil through a first distributor, a second ignition coil having a second primary coil and a second secondary coil and connected to said ignition switch through a relay switch means for connecting said second ignition coil to said power source during low speed rotation at high load, a parallel connection of a second interrupter and a second capacitor connected in series to said second primary coil, said second ignition plug being connected to said second secondary coil through a second distributor, said relay switch means including an exciting coil connected at one end thereof to said ignition switch through an engine revolution switch and an engine load switch which are connected in parallel with each other and connected to another end thereof to ground.

6. An ignition arrangement as claimed in claim 5, wherein said engine revolution switch is arranged to be opened in a low revolution range where engine revolutions are below a predetermined set value and to be closed in a high revolution range where the engine revolutions are above said predetermined set value, and said engine load switch is adapted to be opened at a large load range where the engine load is above a predetermined set value and to be closed at a small load range where the engine load is below said predetermined set value, whereby said second ignition coil is connected to the power source only during large load and low revolution periods.

7. An ignition arrangement as claimed in claim 1, wherein said electrical circuit means comprises a power source, an ignition switch, a first circuit directly connected to said power source through said ignition switch for energizing said first ignition plug, a second circuit connected to the power source through said ignition switch for energizing the second ignition plug, and switch means positioned between said second circuit and said ignition switch for connection or disconnection therebetween according to the state of engine operation so as to cause said second ignition plug to function or not to function.

8. An ignition arrangement as claimed in claim 7, wherein said switch means comprises means for connecting said ignition switch with said second circuit during low speed rotation at high load of the engine so as to cause said second ignition plug to function.

* * * * *